US012121956B1

(12) United States Patent
Osgood et al.

(10) Patent No.: US 12,121,956 B1
(45) Date of Patent: Oct. 22, 2024

(54) CASTING ASSEMBLY

(71) Applicant: GENERAL ELECTRIC COMPANY, Schenectady, NY (US)

(72) Inventors: Daniel Endecott Osgood, Loveland, OH (US); Evin Nathaniel Barber, Logan, UT (US); Brian Patrick Peterson, Madeira, OH (US); Xi Yang, Liberty Township, OH (US); Brian D. Przeslawski, Dayton, OH (US); Christopher D. Barnhill, Cincinnati, OH (US); Douglas G. Konitzer, West Chester, OH (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 18/321,216

(22) Filed: May 22, 2023

(51) Int. Cl.
*B22C 9/10* (2006.01)
*B22C 9/24* (2006.01)

(52) U.S. Cl.
CPC . *B22C 9/10* (2013.01); *B22C 9/24* (2013.01)

(58) Field of Classification Search
CPC ..... B22C 9/10; B22C 9/24
See application file for complete search history.

(56) References Cited

U.S. PATENT DOCUMENTS

| | | | | |
|---|---|---|---|---|
| 6,530,416 | B1 | 3/2003 | Tiemann | |
| 6,766,850 | B2 | 7/2004 | Gegel et al. | |
| 10,449,601 | B2 | 10/2019 | Cogneras et al. | |
| 10,815,827 | B2 | 10/2020 | Swift et al. | |
| 10,821,498 | B2 | 11/2020 | Kyttanen | |
| 11,173,542 | B2 | 11/2021 | Yang et al. | |
| 11,235,378 | B2 | 2/2022 | Yang et al. | |
| 11,267,044 | B2 | 3/2022 | Kuo et al. | |
| 2012/0291983 | A1* | 11/2012 | Graham | B22D 29/002 164/6 |
| 2015/0306657 | A1 | 10/2015 | Frank | |
| 2018/0009128 | A1 | 1/2018 | Sokol et al. | |
| 2018/0161852 | A1 | 6/2018 | McCarren | |
| 2018/0161866 | A1 | 6/2018 | Deines et al. | |

* cited by examiner

*Primary Examiner* — Kevin P Kerns
*Assistant Examiner* — Steven S Ha
(74) *Attorney, Agent, or Firm* — McGarry Bair PC

(57) ABSTRACT

A casting assembly includes a core body extending along an axial direction between a first end and a second end, the core body having a core interior surface and a core exterior surface, with the core exterior surface shaping a part surface of a cast part. The core interior surface at least partially bounds a hollow cavity. The casting assembly also includes a shell body extending along the axial direction and having a first shell surface and a second shell surface, with at least a portion of the second shell surface facing the exterior surface of the core body.

20 Claims, 9 Drawing Sheets

CASTING ASSEMBLY

TECHNICAL FIELD

The disclosure generally relates to a casting assembly, and more specifically to a casting assembly with a shell/core arrangement.

BACKGROUND

Casting processes such as investment casting, metal casting, sand casting, or the like can be used to form a variety of cast parts. Casting processes typically include a core at least partially surrounded by an outer shell to form an intermediate cavity. Molten material can be introduced into the cavity to form the cast part, and at least one of the core or shell are typically removed thereafter. In some examples the core can be formed of a sacrificial material, such as wax, that can be recovered after casting. In some examples, the core can include a frangible material such that the core may be crushed or broken apart for removal. In some examples, the core can remain within the cast part after the casting process is completed.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1:
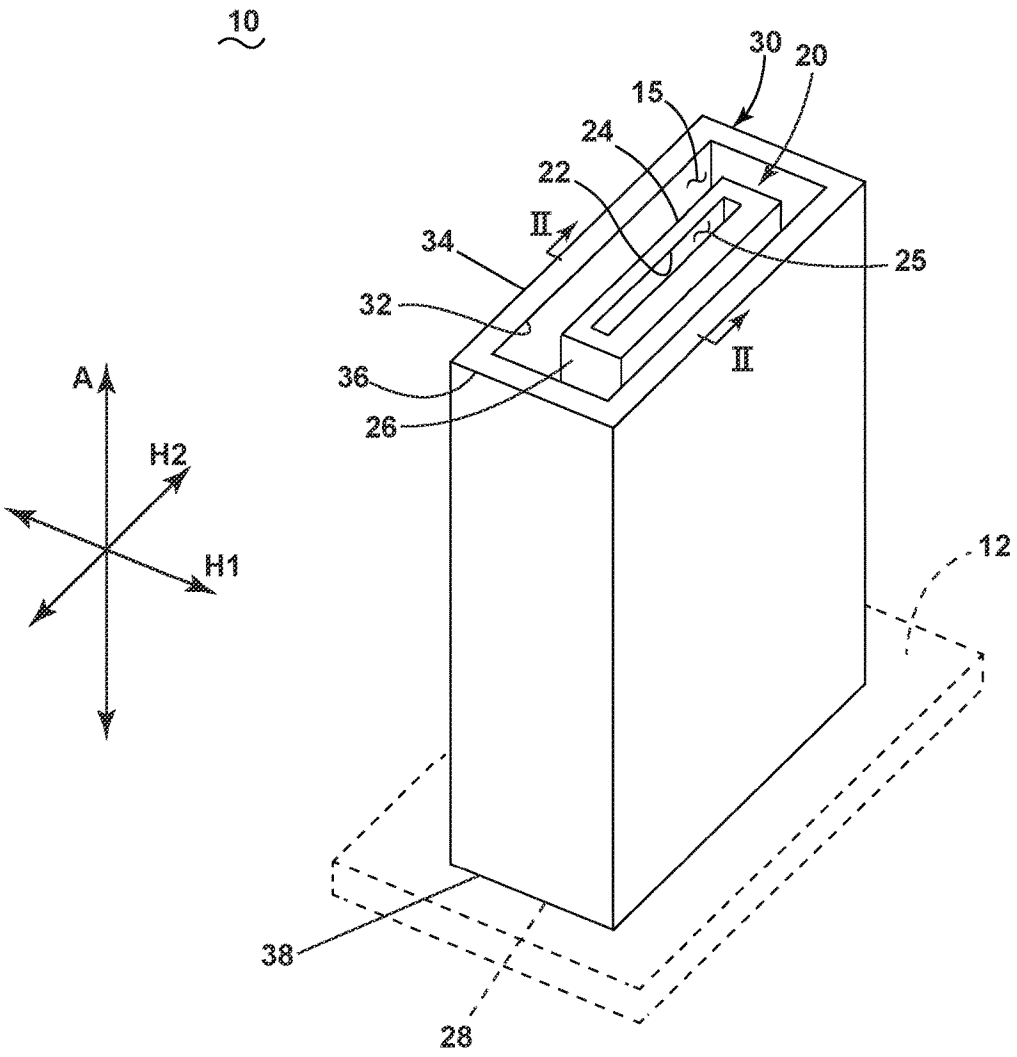
FIG. 1 is a schematic perspective view of a casting assembly in accordance with various aspects described herein.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As may be used herein, the terms "first," "second," and "third" can be used interchangeably to distinguish one component from another and are not intended to signify location or importance of the individual components.

The terms "upstream" and "downstream" refer to the relative direction with respect to a flow in a pathway. For example, with respect to a fluid flow, "upstream" refers to the direction from which the fluid flows, and "downstream" refers to the direction to which the fluid flows.

The term "fluid" refers to a gas or a liquid. The terms "fluid communication" or "fluid coupling" means that a fluid is capable of making the connection between the areas specified.

The singular forms "a", "an", and "the" include plural references unless the context clearly dictates otherwise.

As used herein, an "additively manufactured" component will refer to a component formed by an additive manufacturing (AM) process, wherein the component is built layer-by-layer by successive deposition of material. AM is an appropriate name to describe the technologies that build 3D objects by adding layer-upon-layer of material, whether the material is plastic, ceramic, or metal. AM technologies can utilize a computer, 3D modeling software (Computer Aided Design or CAD), machine equipment, and layering material. Once a CAD sketch is produced, the AM equipment can read in data from the CAD file and lay down or add successive layers of liquid, powder, sheet material or other material, in a layer-upon-layer fashion to fabricate a 3D object. It is understood that the term "additive manufacturing" encompasses many technologies including subsets like 3D Printing, Rapid Prototyping (RP), Direct Digital Manufacturing (DDM), layered manufacturing and additive fabrication. Non-limiting examples of additive manufacturing that can be utilized to form an additively-manufactured component include powder bed fusion, vat photopolymerization, binder jetting, material extrusion, directed energy deposition, material jetting, or sheet lamination. It is also contemplated that a process utilized could include printing a negative of the part, either by a refractory metal, ceramic, or printing a plastic, and then using that negative to cast the component.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and include intermediate structural elements between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

As used herein, a "body area" (denoted "$A_b$") of a casting assembly core body having a core exterior surface refers to a cross-sectional area bounded by the core exterior surface in a cross-sectional plane through the casting assembly.

As used herein, a "hollow area" (denoted "$A_h$") of a casting assembly core body having a core interior surface bounding a hollow cavity refers to a cross-sectional area of the hollow cavity in a cross-sectional plane through the casting assembly.

As used herein, a "minimum core thickness" (denoted "$CT_{min}$") of the core body refers to a minimum material thickness between the core exterior surface and the core interior surface in a cross-sectional plane through the casting assembly. In an exemplary implementation where the core body includes multiple hollow cavities bounded by corresponding multiple core interior surfaces, each core interior surface defines a minimum core thickness $CT_{min}$ in the cross-sectional plane with respect to the core exterior surface.

As used herein, a "maximum core thickness" (denoted "$CT_{max}$") of the core body refers to a maximum material thickness between the core exterior surface and the core interior surface in a cross-sectional plane through the casting assembly. In an exemplary implementation where the core body includes multiple hollow cavities bounded by corresponding multiple core interior surfaces, each core interior surface defines a maximum core thickness $CT_{max}$ in the cross-sectional plane with respect to the exterior surface.

As used herein, a "minimum shell thickness" (denoted "$ST_{min}$") of a assembly shell body having a first shell surface and a second shell surface bounding a part cavity, where the first shell surface is fluidly isolated from the part cavity, refers to a minimum material thickness between the first shell surface and the second shell surface in a cross-sectional plane through the casting assembly.

As used herein, a "hollow cavity parameter" (denoted "HCP") refers to a value describing a relationship between the body area $A_b$, the hollow area $A_h$, the minimum core thickness $CT_{min}$, the maximum core thickness $CT_{max}$, and the minimum shell thickness $ST_{min}$.

Aspects of the disclosure are directed to a casting assembly with at least a core body and a shell body. At least one of the first or second bodies can be printed in an additive manufacturing process. In some implementations, the core body defines a casting core and the shell body defines a casting shell spaced from and at least partially surrounding the casting core. The core body defines a pattern for portions of the cast part. In some implementations, the casting assembly forms a cooled airfoil having interior cooling passages and film cooling holes.

The core body and the shell body are arranged relative to one another to form a part cavity. In some implementations, one or more elongated ligaments are provided that extend between the core body and the shell body. Such ligaments can provide for maintaining a spacing distance between the first and second bodies, or for forming an aperture through the cast part. Typically, the ligaments have a smaller thickness compared to the core body or the shell body.

Once assembled, the casting assembly is then heat-treated/fired and cooled, thereby hardening or strengthening the casting assembly to receive molten material. The molten material is poured, injected, or otherwise introduced into the part cavity to form a cast part. The casting assembly and cast part are cooled, and at least one of the first or second bodies is subsequently removed from the cast part to form a finished component.

When one or both of the bodies is printed by additive manufacturing, one factor to consider is that during printing of the body, the thickness of the body generates internal stresses as additional layers are added to the body that can cause deformations, surface irregularities, or other printing issues. It is appreciated that such printing issues lead to corresponding irregularities in the finished part.

Regardless of whether the bodies are made by additive manufacturing, another factor to consider is that during firing of the casting assembly, thermal contraction of the first and second bodies leads to geometric shrinkage. The thickness of the first or shell body corresponds to their thermal masses and amounts of shrinkage. If the first and second bodies differ significantly in thickness, they can undergo shrinkage at different amounts or rates leading to geometric irregularities in the casting assembly.

Another factor to consider during casting is that when molten material is provided to the casting assembly, thermal contraction and solidification shrinkage of the cast part occurs during cooling and hardening. This effect leads to a reduction in size of the cast part relative to the design dimensions of the part cavity.

Yet another factor to consider is that the cast part experiences internal stresses during cooling and hardening. For instance, unequal shrinkage rates across the cast part due to variances in part thickness can lead to cracking, fracturing, or grain defects.

Still another factor to consider is that, during cooling and hardening, the cast part applies various forces on the casting assembly as each component cools at different rates. Such forces can lead to shearing, yielding, or fracturing of the casting assembly. For instance, thermal contraction or solidification shrinkage of the cast part bound within the casting assembly can generate shear forces on ligaments in the casting assembly, leading to fracturing of the ligament and corresponding geometric irregularities in the cast part.

Still another factor to consider is that the casting assembly also undergoes thermal contraction and deformation around the cast part during cooling and hardening. Material selection and geometry of the casting assembly leads to a trade-off between strength needed to contain the molten material and flexibility needed for deformation such that the casting assembly does not place excessive forces on the cast part during solidification.

The standard practice for solving the above-described problems has been to design the casting assembly with the first and second bodies having similar thicknesses, which provides for more uniform thermal effects (e.g. shrinkage) within the casting assembly and for more uniform thermal interaction between the casting assembly and cast part. However, such an approach is difficult when casting parts with large internal cavities. For instance, casting processes are known for producing cooled airfoils with large internal cooling channels and a plurality of small-aperture cooling holes extending from the internal cooling channels through the outer wall. In such a case, one or more large central cores are formed with or coupled to a plurality of much smaller and thinner ligaments. During a casting process, the central core(s) and the plurality of smaller ligaments are placed within a casting shell to form the central cooling channel(s) and the plurality of cooling holes, respectively, in the cast part. Varied component thicknesses in the cast part lead to mismatched thermal properties or thermal characteristics between the central core and casting shell. Such thermal-property mismatch generates excessive shear forces on the ligaments during casting when molten material is introduced and cooled, leading to irregularities in the cooling-hole apertures in the finished part.

The inventors' practice has proceeded in the manner of designing a casting assembly for a selected part design, printing the casting assembly, and modifying the casting assembly design as needed based on printing stresses or irregularities in the printed first or second bodies. The inventors' practice has then proceeded in the manner of firing and casting, examining the resulting part for undesirable properties, features or flaws, and making additional modifications to the casting assembly design as needed based on thermal properties, internal stresses, component shear, or the like as described above. A part is made from the modified casting assembly and the process is repeated. This repeated trial/error process continues for long periods of time until a workable casting assembly design is identified for a given cast part. The above-described iterative process is then repeated for each casting assembly corresponding to each cast part desired for production. A description of examples of a novel casting assembly developed by the inventors is provided below.

Referring now to the drawings, FIG. 1 illustrates a casting assembly 10 in accordance with various aspects described herein. The casting assembly 10 includes a core body 20 and a shell body 30. A mold base 12 for supporting the casting assembly 10 is schematically illustrated. In some exemplary implementations, the mold base 12 can be integrated with the core body 20 or the shell body 30.

For reference purposes, a set of relative reference directions along with a coordinate system are shown in FIG. 1. The casting assembly 10 defines an axial direction A, which is shown extending vertically along the page. First and second horizontal axes H1, H2 each extend orthogonally to the axial direction A, and each of which are shown extending partially into the page.

In the exemplary illustration shown, the core body 20 is a rectangular prism and the shell body 30 is a hollow rectangular prism. It is understood that the core body 20 or the shell body 30 can have any geometric profile. In addition, either or both of the core body 20 or the shell body 30 are formed of monolithic ceramic.

The core body 20 includes a core interior surface 22 and a core exterior surface 24. In the illustrated example, the core body 20 is a single body having the core interior surface 22 and core exterior surface 24. In another non-limiting implementation, the core body 20 includes a central body with an outer layer, overshell, skin, or the like that defines the core exterior surface 24, as well as a central body with an inner layer, shell, skin, or the like that defines the core interior surface 22.

The shell body 30 includes a first shell surface 31 and a second shell surface 32. The second shell surface 32 bounds a part cavity 15 as shown. The core exterior surface 24 is spaced from the second shell surface 32. The first shell surface 31 is fluidly isolated from the part cavity 15. In some implementations, the first shell surface 31 defines an exterior surface of the shell body 30. In some implementations, the shell body 30 includes an additional cavity or hollow region bounded by the first shell surface 31.

The core body 20 extends along the axial direction A between a first end 26 and a second end 28. The shell body 30 also extends along the axial direction A between a first end 36 and a second end 38. In the exemplary implementation shown, the first ends 26, 36 and the second ends 28, 38 are aligned with one another such that the first and second bodies 20, 30 have the same axial length.

In addition, the core interior surface 22 at least partially bounds a hollow cavity 25 within the core body 20. The hollow cavity 25 is fluidly isolated or separated from the part cavity 15. Any number of hollow cavities 25 can be provided in the core body 20.

In the exemplary implementation shown, the casting assembly 10 is in the form of an investment casting mold, wherein the core body 20 defines a casting core and the shell body 30 defines a casting shell that surrounds the casting core. During operation, molten material is introduced into the part cavity 15 and hardens to form a cast part. The core exterior surface 24 is exposed to the molten material and forms an interior part surface of the cast part. The second shell surface 32 forms an exterior part surface of the cast part. It is understood that the core interior surface 22 is fluidly isolated from the part cavity 15 and is not exposed to the molten material during casting.

It is also understood that described aspects of the casting assembly 10 can have other exemplary implementations. In another example, the shell body 30 partially surrounds the core body 20 to form an outer edge or exterior tip of the cast part, such as by way of a closed end or cap at one end of the shell body 30 confronting the core body 20.

Figure 2:
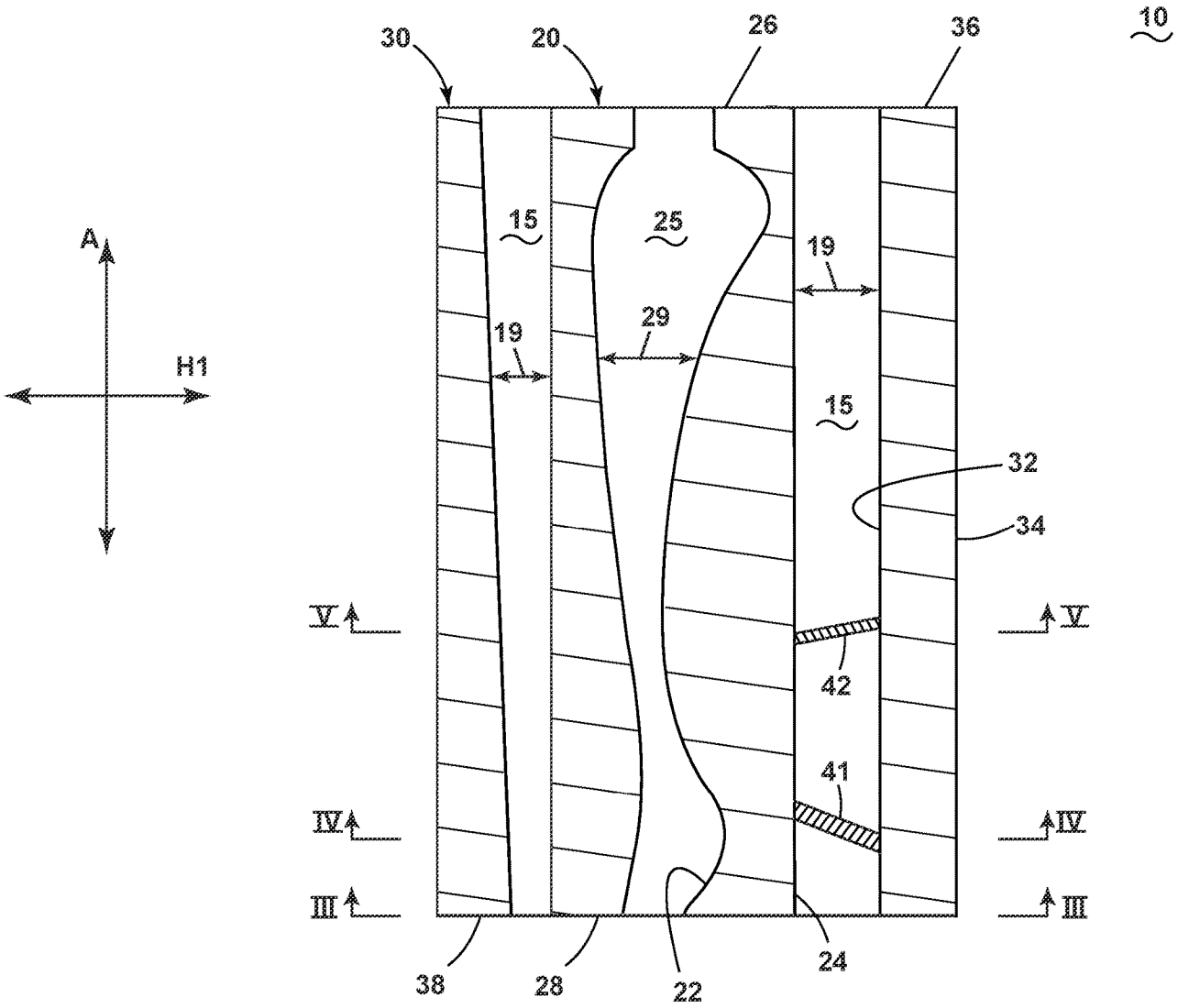
FIG. 2 is a cross-sectional view of the casting assembly of FIG. 1 taken along line II-II and illustrating a core body, a shell body, and a hollow cavity in accordance with various aspects described herein.

Turning to FIG. 2, a side cross-sectional view of the casting assembly 10 illustrates additional details of the part cavity 15 and the hollow cavity 25. The axial direction A and the first horizontal axis H1 are indicated.

A part cavity width 19 is defined between the second shell surface 32 and the core exterior surface 24. A hollow cavity width 29 is defined by the core interior surface 22. In the exemplary implementation shown, the part cavity width 19 and the hollow cavity width 29 are variable along the axial direction A. The hollow cavity width 29 is narrowed at the first and second ends 26, 28 of the core body 20. The hollow cavity width 29 is also widened in portions of the core body 20 spaced from the first and second ends 26, 28. Put another way, as shown, the hollow cavity width 29 has a maximum value at a location spaced from the first end 26 and the second end 28. In addition, as shown, the part cavity width 19 is constant in one portion of the part cavity 15 and variable in another portion of the part cavity 15 along the axial direction A. It is understood that the part cavity 15 and hollow cavity 25 can have a variety of geometric profiles along the axial direction A. In this manner, in some exemplary implementations, either or both of the part cavity width 19 or the hollow cavity width 29 are constant or variable along the axial direction A.

The casting assembly 10 can also include one or more ligaments in some implementations. In the example shown, a first ligament 41 and a second ligament 42 are provided in the casting assembly 10. The first and second ligaments 41, 42 extend across the part cavity 15 from the core body 20 to the shell body 30. In the illustrated example, the first and second ligaments 41, 42 also extend partially into the page as seen in FIG. 3.

As shown, the first ligament 41 and the second ligament 42 are each separate components coupled to the first and second bodies 20, 30. In some implementations, the first ligament 41 and the second ligament 42 are unitarily formed or additively manufactured with at least one of the core body 20 or the shell body 30. In some implementations the core body 20, the shell body 30, the first ligament 41, and the second ligament 42 are formed as a single, unitary component by additive manufacturing methods. Such ligaments form a hollow aperture extending through the cast part, such as a cooling hole, slot, or the like.

Figure 3:
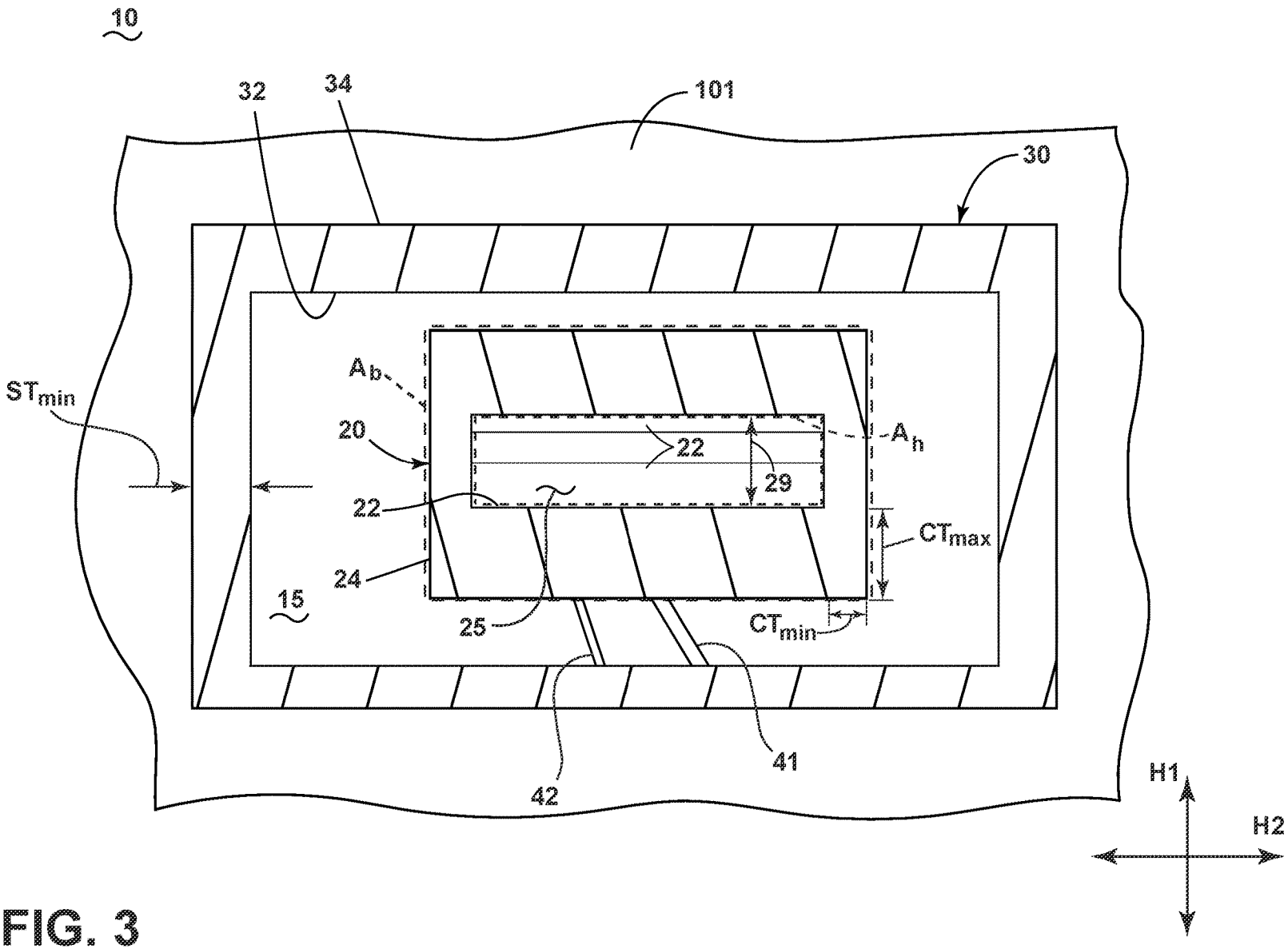
FIG. 3 is a cross-sectional view of the casting assembly of FIG. 2 taken along line III-III.
Figure 4:
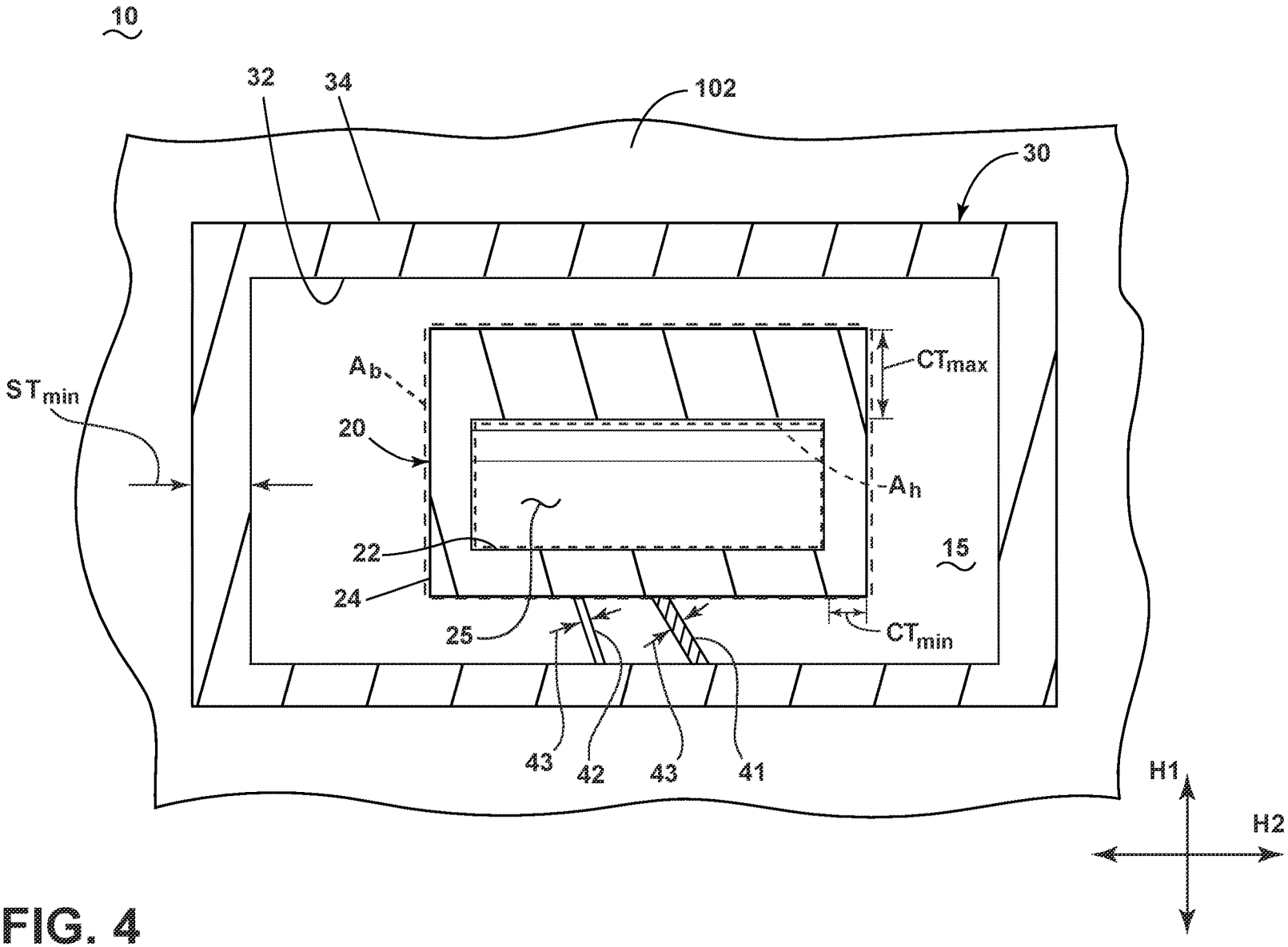
FIG. 4 is a cross-sectional view of the casting assembly of FIG. 2 taken along line IV-IV.
Figure 5:
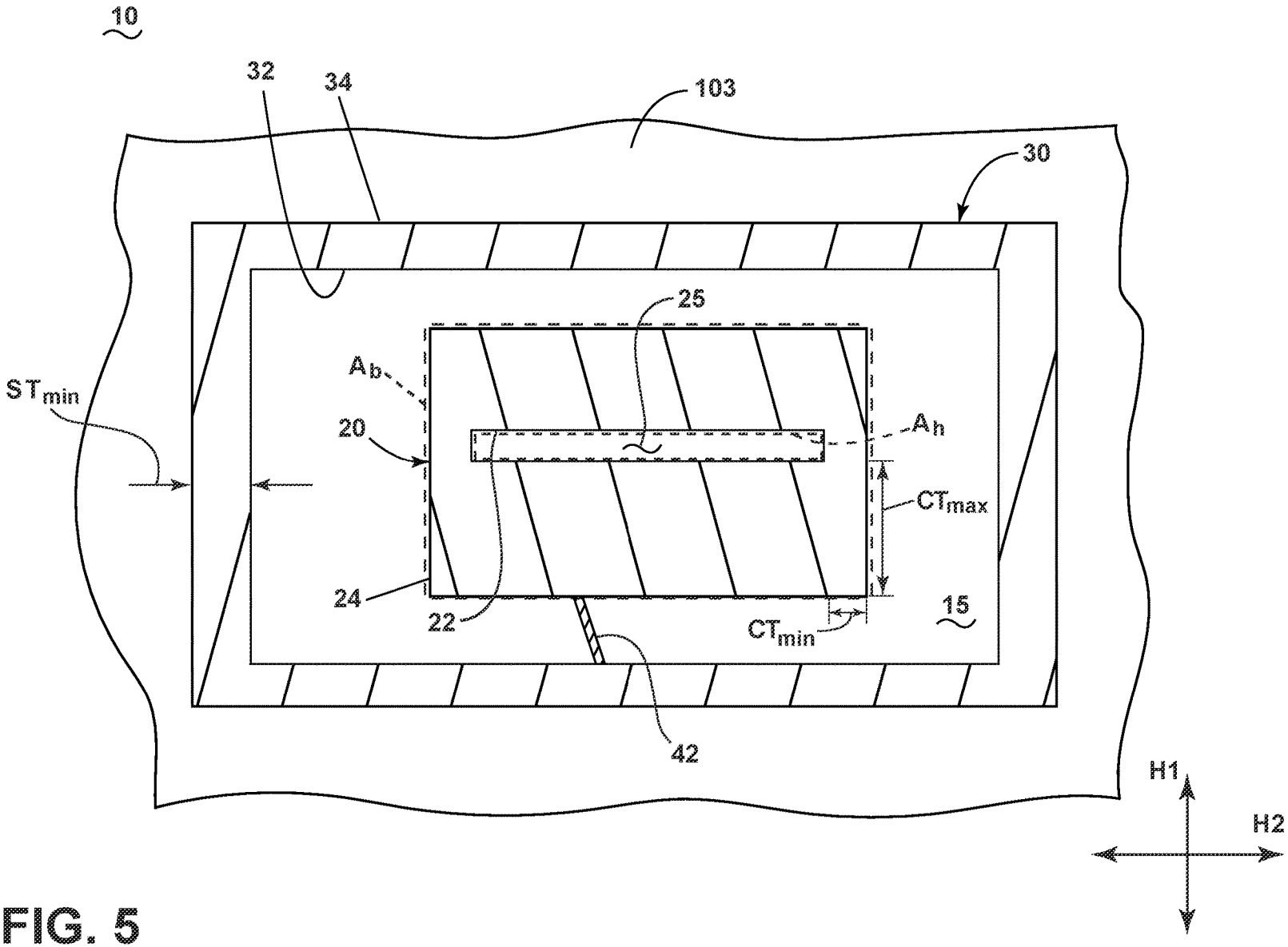
FIG. 5 is a cross-sectional view of the casting assembly of FIG. 2 taken along line V-V.

FIGS. 3-5 illustrate various cross-sectional views of the casting assembly 10 taken along co-parallel planes indicated by lines IV-IV, and V-V of FIG. 2. Referring now to FIG. 3, an axial cross-sectional view of the casting assembly 10 is shown along line of FIG. 2. A first cross-sectional plane 101 (also referred to herein as "first plane 101") corresponding to line is indicated for reference. The first and second horizontal axes H1, H2 are also indicated for reference. It is understood that the axial direction A (FIG. 2) is normal to the first cross-sectional plane 101.

The first plane 101 is located at the second ends 28, 38 of the first and second bodies 20, 30. In the axial view of FIG.

3, the core interior surface 22 is shown forming a variable hollow cavity width 29 as described above.

In the first plane 101, a maximum core thickness $CT_{max}$ and a minimum core thickness $CT_{min}$ is defined between the core interior surface 22 and the core exterior surface 24. The core interior surface 22 bounds a hollow area $A_h$, and the core exterior surface 24 bounds a body area $A_b$ as shown. In addition, in the first plane 101, a minimum shell thickness $ST_{min}$ is defined in the shell body 30 between the second shell surface 32 and the first shell surface 31.

FIG. 4 illustrates another axial cross-sectional view of the casting assembly 10 along line IV-IV of FIG. 2. A second cross-sectional plane 102 (also referred to herein as "second plane 102") corresponding to line IV-IV is indicated for reference. The first and second horizontal axes H1, H2 are also indicated for reference. It is understood that the second plane 102 is normal to the axial direction A (FIG. 2).

In the second plane 102, the maximum core thickness $CT_{max}$, the minimum core thickness $CT_{min}$, the hollow area $A_h$, and the body area $A_b$ are shown in the core body 20. The minimum shell thickness $ST_{min}$ of the shell body 30 is also shown. It is understood that the maximum core thickness $CT_{max}$, the minimum core thickness $CT_{min}$, the hollow area $A_h$, the body area $A_b$, or the minimum shell thickness $ST_{min}$ can vary in different cross-sectional planes.

In addition, the first ligament 41 and the second ligament 42 each define a ligament thickness 43 as shown. In some implementations, the minimum core thickness $CT_{min}$ is between 0.9-40 times the ligament thickness 43.

FIG. 5 illustrates another cross-sectional view of the casting assembly 10 along line V-V of FIG. 2. A third cross-sectional plane 103 (also referred to herein as "third plane 103") corresponding to line V-V is indicated for reference. The first and second horizontal axes H1, H2 are also indicated for reference. It is understood that the axial direction A (FIG. 2) is normal to the third plane 103.

In the third plane 103, the maximum core thickness $CT_{max}$, the minimum core thickness $CT_{min}$, the hollow area $A_h$, and the body area $A_b$ are shown in the core body 20. The minimum shell thickness $ST_{min}$ of the shell body 30 is also shown. A second ligament 42 is also provided in the casting assembly 10. The second ligament 42 extends across the part cavity 15 from the core body 20 to the shell body 30. In the non-limiting implementation shown, the second ligament 42 forms a support structure between the core body 20 and the shell body 30. It is understood that ligaments can be provided in any portion of the part cavity 15.

With general reference to FIGS. 1-5, at least one of the body area $A_b$, the hollow area $A_h$, the minimum core thickness $CT_{min}$, the maximum core thickness $CT_{max}$, or the minimum shell thickness $ST_{min}$, are non-constant along the axial direction. For instance, the maximum core thickness $CT_{max}$ is larger in the third plane 103 compared to the first plane 101. As shown, the body area $A_b$ is constant along the axial direction A, and each of the hollow area $A_h$, the minimum core thickness $CT_{min}$, the maximum core thickness $CT_{max}$, and the minimum shell thickness $ST_{min}$ are non-constant along the axial direction A.

When the core body 20 is made by additive manufacturing, the hollow cavity 25 reduces the core body thickness, which leads to a reduction in print forces or internal stresses in portions of the core body 20 during printing. In addition, during casting and firing, the hollow cavity 25 provides for the reduction in core thickness such that thermal properties of the first and second bodies 20, 30 are more similar compared to a solid core body 20. As described above, such matching of thermal properties between the casting assembly 10 and the cast part reduces internal stresses within the cast part as well as shear or other forces on the casting assembly 10. In addition, the hollow cavity 25 in the core body 20 can be sized or tailored to anticipate shrinkage that occurs during firing of the casting assembly 10, which can improve the accuracy of the dimensions of the cast part. For instance, in some exemplary implementations the casting assembly 10 is used to form a thin-walled cast part with in the part cavity 15, which is sensitive to shrinkage or other casting irregularities. In such a case, the core body 20 is provided with a corresponding large hollow cavity 25 for improved thermal similarity to the thin-walled cast part. The hollow cavity 25 being fluidly isolated from the part cavity 15 further provides for easier removal from the cast part, as the core body 20 can be crushed, segmented, or the like for extraction from the first or second ends 36, 38.

Figure 6:
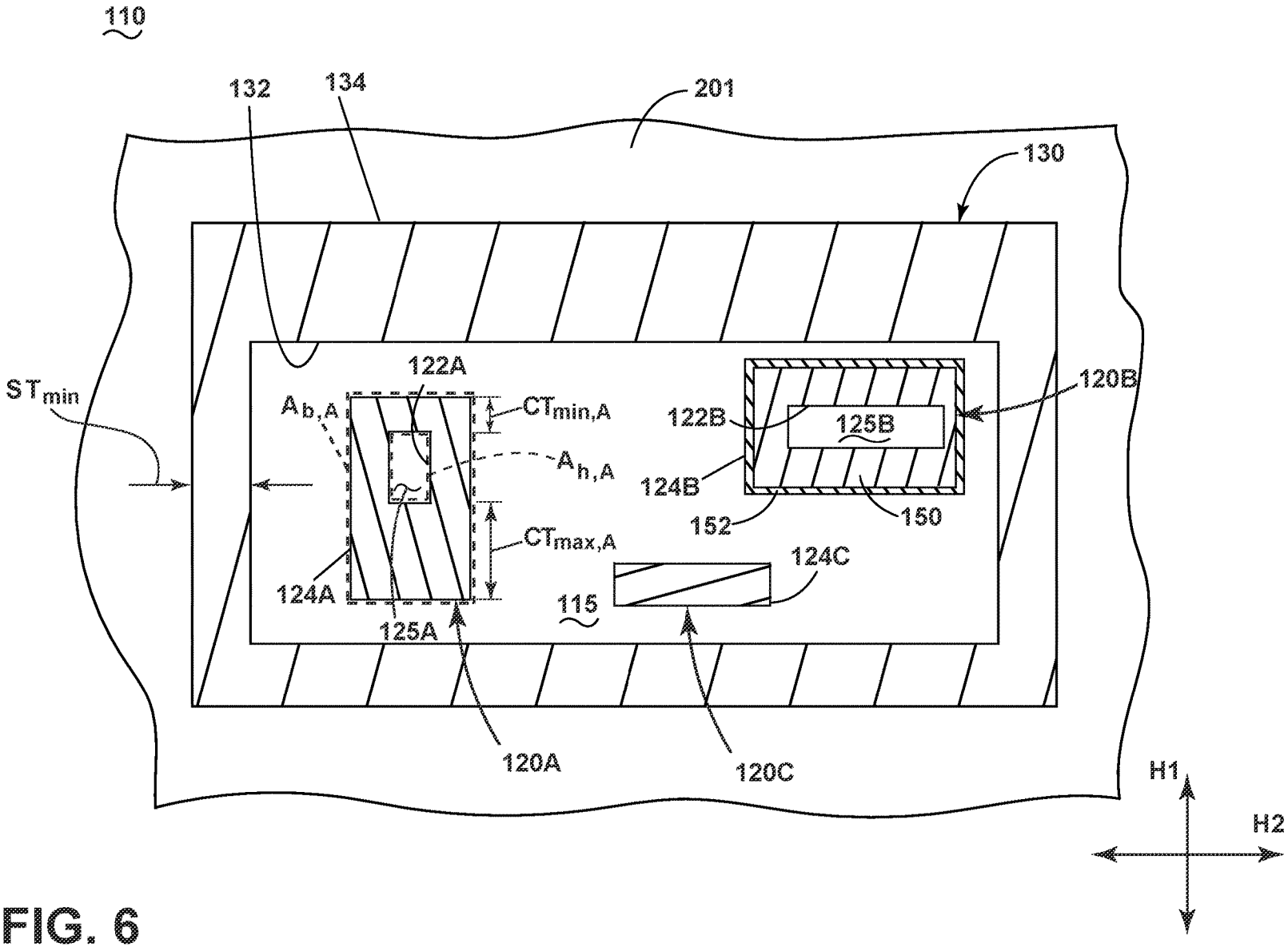
FIG. 6 is a cross-sectional view of another casting assembly, similar to the casting assembly of FIG. 1, and illustrating a first core body and a first hollow cavity in accordance with various aspects described herein.

Turning to FIG. 6, another casting assembly 110 is shown in accordance with various aspects described herein. The casting assembly 110 is similar to the casting assembly 10; therefore, like parts will be described with like numerals increased by 100, with it being understood that the description of the like parts of the casting assembly 10 applies to the casting assembly 110, except where noted.

The casting assembly 110 is shown in cross-section through a cross-sectional plane 201 similar to the first cross-sectional plane 101 (FIG. 3). The first and second horizontal axes H1, H2 are also indicated for reference. It is understood that the axial direction A (FIG. 2) is normal to the cross-sectional plane 201.

A shell body 130 is provided and includes a first shell surface 131 and a second shell surface 132. The second shell surface 132 bounds a part cavity 115 as shown. In some implementations, the first shell surface 131 defines an exterior surface of the shell body 130. In some implementations, the shell body 130 includes an additional cavity or hollow region bounded by the first shell surface 131.

In the illustrated example, the shell body 130 is a single body having the first shell surface 131 and the second shell surface 132. In another non-limiting implementation, the shell body 130 includes a central body with an outer layer, overshell, skin, or the like that defines the first shell surface 131, as well as a central body with an inner layer, shell, skin, or the like that defines the second shell surface 132.

One difference compared to the casting assembly 10 is that the casting assembly 110 includes multiple core bodies within the part cavity 115. As shown, a first core body 120A, a second core body 120B, and a third core body 120C are positioned within the part cavity 115. Any number of core bodies can be provided.

The first, second, and third core bodies 120A, 120B, 120C are similar to the core body 20 (FIG. 2). The first and second core bodies 120A, 120B include a respective first and second interior surface 122A, 122B and a respective first and second exterior surface 124A, 124B. The first and second interior surfaces 122A, 122B bound a respective first and second hollow cavity 125A, 125B. The first and second hollow cavities 125A, 125B are each fluidly isolated from the part cavity 115.

The third core body 120C includes a third exterior surface 124C. Another difference compared to the casting assembly 10 is that the third core body 120C is a solid body with no hollow cavity.

In the illustrated example, the first core body 120A is a single body having the first interior surface 122A and first exterior surface 124A, and the third core body 120C is a single body having the third exterior surface 124C. Another difference compared to the casting assembly 10 is that the second core body 120B includes a central body 150 coupled to an overshell or outer layer 152. In the non-limiting implementation shown, the central body 150 defines the second interior surface 122B, and the outer layer 152 defines the second exterior surface 124B. In one non-limiting implementation, at least one of the central body 150 or the outer layer 152 includes at least one of a ceramic material, a metallic material, alumina, silica, zircon, molybdenum, tungsten, aluminum, or a combination thereof. In still another non-limiting implementation, at least one of the first or third core bodies 120A, 120C includes a central body with an outer layer, overshell, skin, or the like that defines the corresponding first exterior surface 124A or third exterior surface 124C. In another non-limiting implementation, the first core body 120A includes an inner layer, shell, skin, or the like that defines the first interior surface 122A.

In the cross-sectional plane 201, a minimum first core thickness $CT_{min,A}$ and a maximum first core thickness $CT_{max,A}$ is defined between the first interior surface 122A and the first exterior surface 124A. The first interior surface 122A bounds a first hollow area $A_{h,A}$, and the first exterior surface 124A bounds a first body area $A_{b,A}$ as shown. In addition, in the cross-sectional plane 201, a minimum shell thickness $ST_{min}$ is defined in the shell body 130 between the second shell surface 132 and the first shell surface 131.

Figure 7:
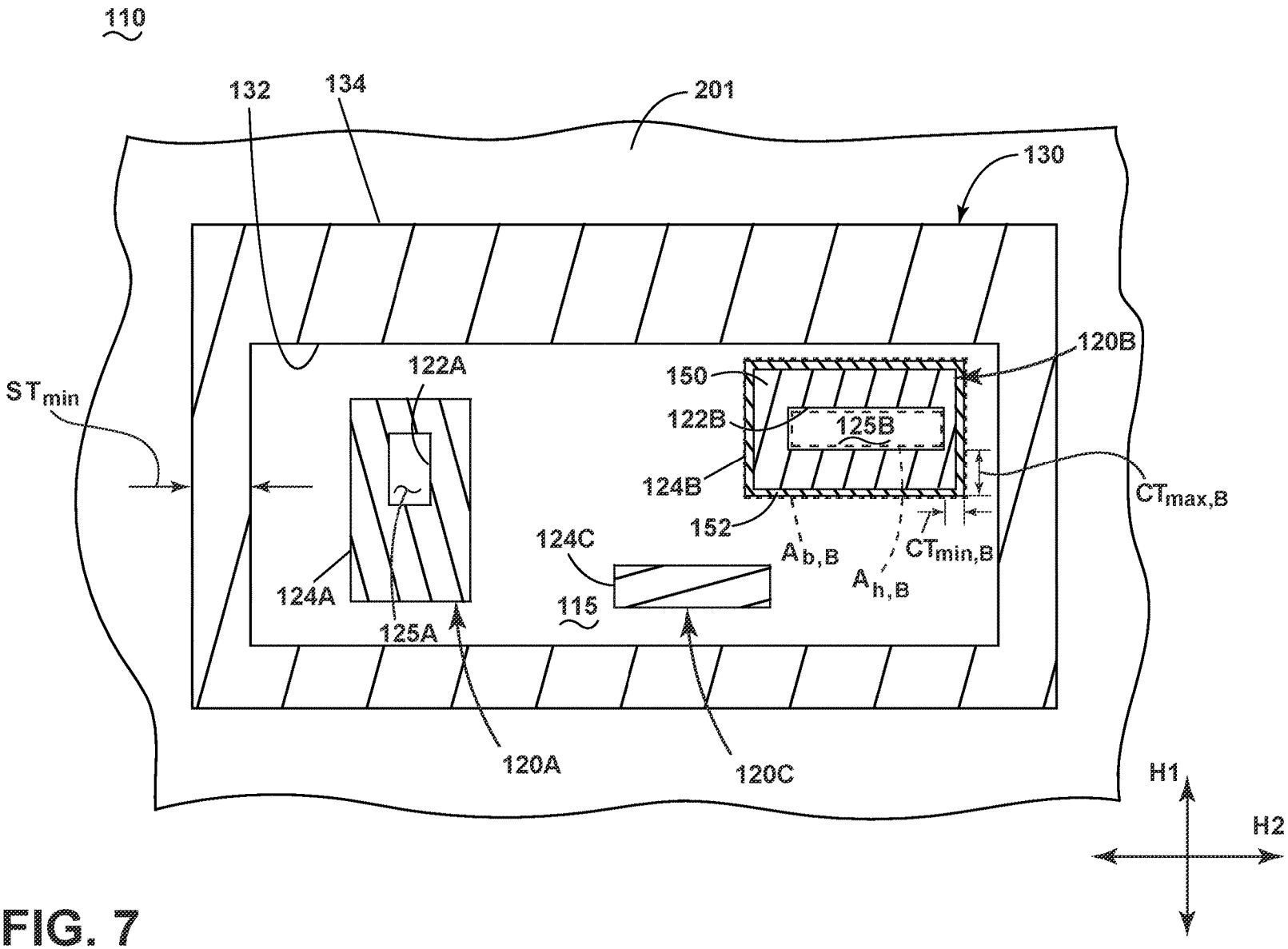
FIG. 7 is a cross-sectional view of the casting assembly of FIG. 6 illustrating a second core body and a second hollow cavity in accordance with various aspects described herein.

FIG. 7 illustrates additional details of the casting assembly 110. In the cross-sectional plane 201, a minimum second core thickness $CT_{min,B}$ and a maximum second core thickness $CT_{max,B}$ is defined between the second interior surface 122B and the second exterior surface 124B. It is understood that the minimum second core thickness $CT_{min,B}$ and the maximum second core thickness $CT_{max,B}$ includes portions of the central body 150 and the outer layer 152. The second interior surface 122B bounds a second hollow area $A_{h,B}$, and the second exterior surface 124B bounds a second body area $A_{b,B}$ as shown.

Figure 8:
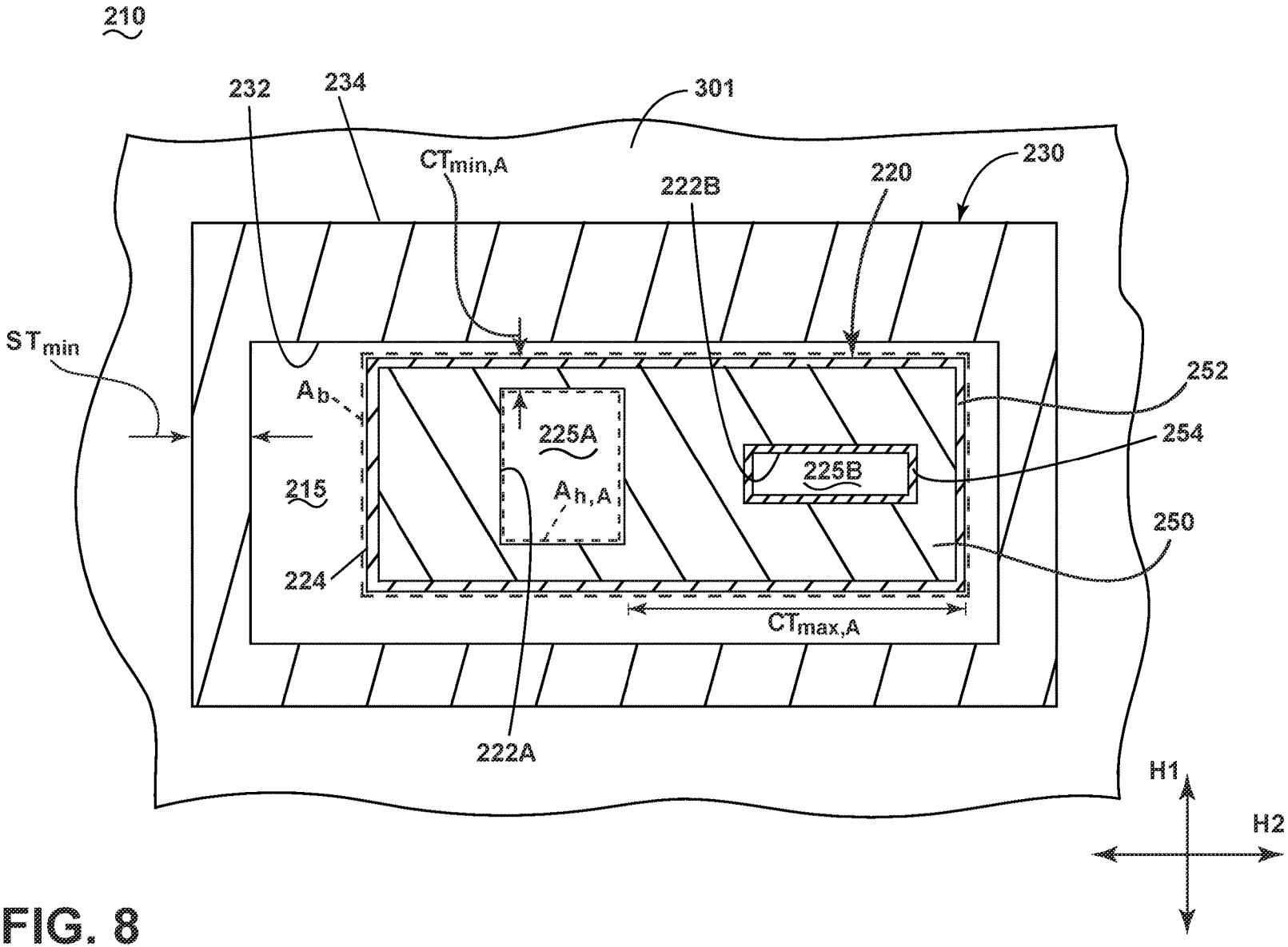
FIG. 8 is a cross-sectional view of another casting assembly, similar to the casting assembly of FIGS. 1 and 6, and illustrating a body with a first hollow cavity in accordance with various aspects described herein.

Referring now to FIG. 8, another casting assembly 210 is shown in accordance with various aspects described herein. The casting assembly 210 is similar to the casting assemblies 10, 110; therefore, like parts will be described with like numerals further increased by 100, with it being understood that the description of the like parts of the casting assemblies 10, 110 applies to the casting assembly 210, except where noted.

The casting assembly 210 is shown in cross-section through a cross-sectional plane 301 similar to the first cross-sectional plane 101 (FIG. 3) and the cross-sectional plane 201 (FIG. 6). The first and second horizontal axes H1, H2 are also indicated for reference. It is understood that the axial direction A (FIG. 2) is normal to the cross-sectional plane 301.

A core body 220 is provided and includes a core exterior surface 224. One difference compared to the casting assemblies 10, 110 is that multiple core interior surfaces are provided within the core body 220. More specifically, the core body 220 includes a first core interior surface 222A and a second core interior surface 222B. The first and second core interior surfaces 222A, 222B bound respective first and second hollow cavities 225A, 225B as shown.

Another difference compared to the casting assemblies 10, 110 is that the core body 220 includes a central body 250 coupled to an overshell or outer layer 252 and an inner layer 254. In one non-limiting example, at least one of the central body 250, the outer layer 252, or the inner layer 254 includes at least one of a ceramic material, a metallic material, alumina, silica, zircon, molybdenum, tungsten, aluminum, or a combination thereof. In the non-limiting implementation shown, the outer layer 252 defines the core exterior surface 224, the inner layer 254 defines the second shell surface 222B, and the central body 250 defines the core interior surface 222A. In another non-limiting implementation, the core body 220 includes a single or monolithic body portion defining the core exterior surface 224 and the interior surfaces 222A, 222B.

A shell body 230 is also provided and includes a first shell surface 231 and a second shell surface 232. The second shell surface 232 bounds a part cavity 215 as shown. In some implementations, the first shell surface 231 defines an exterior surface of the shell body 230. In some implementations, the shell body 230 includes an additional cavity or hollow region bounded by the first shell surface 231.

In the illustrated example, the shell body 230 is a single body having the first shell surface 231 and the second shell surface 232. In another non-limiting implementation, the shell body 230 includes a central body with an outer layer, overshell, skin, or the like that defines the first shell surface 231, as well as a central body with an inner layer, shell, skin, or the like that defines the second shell surface 232.

In the cross-sectional plane 301, each of a minimum core thickness $CT_{min,A}$ and a maximum core thickness $CT_{max,A}$ is defined between the interior surface 222A and the core exterior surface 224. It is understood that the minimum core thickness $CT_{min,A}$ and the maximum core thickness $CT_{max,A}$ includes portions of the central body 250 and the outer layer 252. The interior surface 222A bounds a hollow area $A_{h,A}$ and the core exterior surface 224 bounds a body area $A_b$ as shown. In addition, in the cross-sectional plane 301, a minimum shell thickness $ST_{min}$ is defined in the shell body 230 between the second shell surface 232 and the first shell surface 231.

Figure 9:
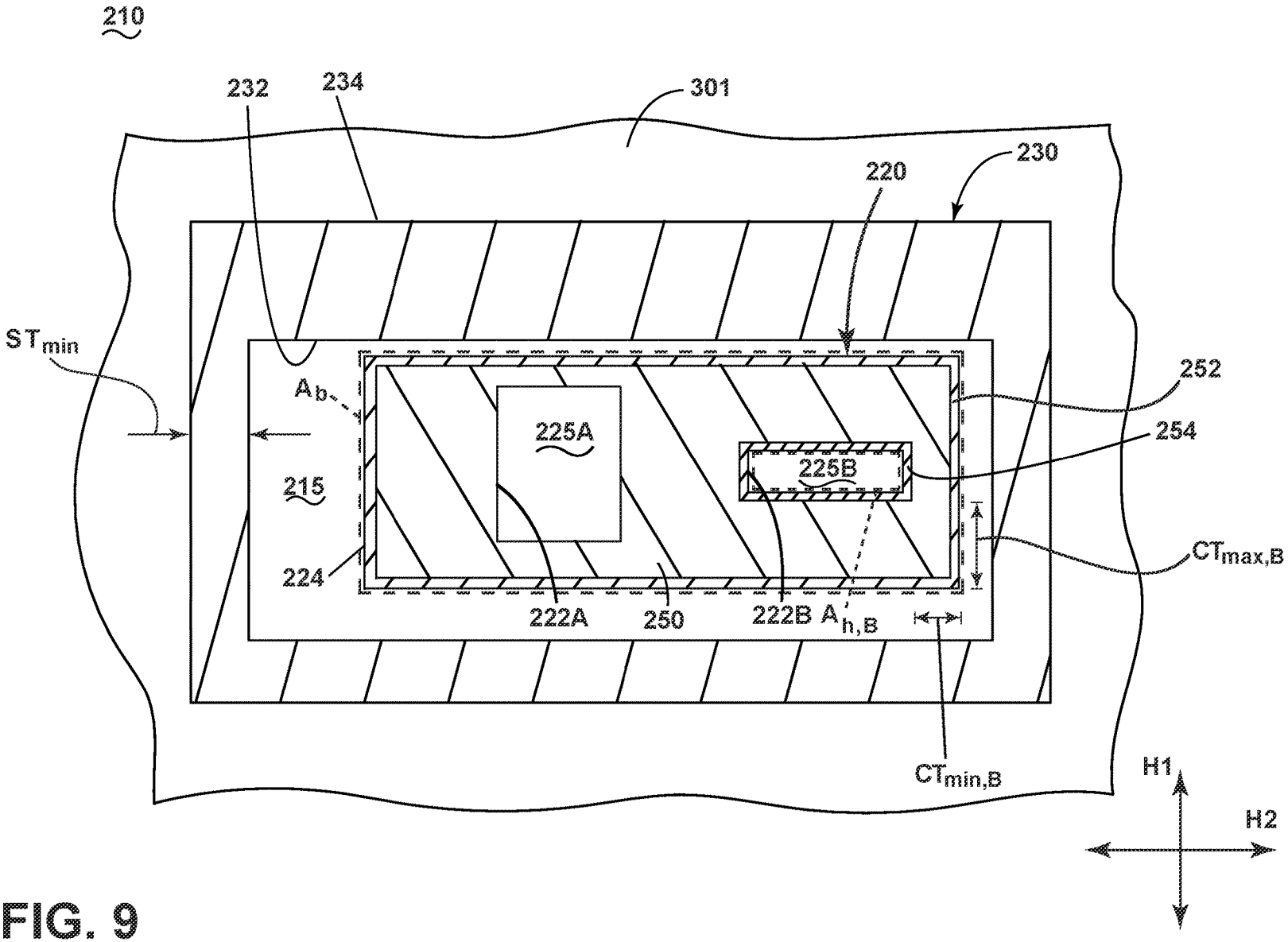
FIG. 9 is a cross-sectional view of the casting assembly of FIG. 8 and illustrating the body with a second hollow cavity in accordance with various aspects described herein.

FIG. 9 illustrates additional details of the casting assembly 210. In the cross-sectional plane 301, each of a minimum core thickness $CT_{min,B}$ and a maximum core thickness $CT_{max,B}$ is defined between the interior surface 222B and the core exterior surface 224. It is understood that the minimum core thickness $CT_{min,B}$ and the maximum core thickness $CT_{max,B}$ includes portions of the central body 250, the outer layer 252, and the inner layer 254. The interior surface 222 bounds a hollow area $A_{h,B}$, and the core exterior surface 224 bounds a body area $A_{b,B}$ as shown.

With general reference to FIGS. 1-9, when the core body 20, 120A, 120B, 120C, 220 is made by additive manufacturing, the hollow cavity(ies) 25, 125A, 125B, 225A, 225B reduce the maximum core thickness compared to a solid core body, which reduces print forces on the core body that may otherwise cause stresses or deformations of the core body as described above. Regardless of whether the core bodies 20, 120A, 120B, 120C, 220 are made by additive manufacturing, the hollow cavities 25, 125A, 125B, 225A, 225B also provide for reduced thickness differences between the core body and cast part, which improves thermal-property similarity across all bodies in the casting assembly 10, 110, 210 during casting and firing, leading to reductions in internal stresses, deformations, shrinkage, and the like in the casting assembly and cast part.

As described earlier, finding a workable casting-assembly design for a given cast part involves finding the balance between cast-part design parameters, corresponding casting-assembly dimensions, material property considerations, and thermal property considerations during printing, firing, and casting. These are labor- and time-intensive processes.

Table 1 below illustrates some examples of casting assemblies that yielded workable solutions to the above-described problems. Each casting assembly example describes values for the minimum core thickness $CT_{min}$, maximum core thickness $CT_{max}$, and hollow area $A_h$ with respect to a core body that contains one or more hollow cavities as described above, such as the hollow cavity 25 in the core body 20 (FIG. 2), the hollow cavity 125B in the second core body 120B (FIG. 6), or the hollow cavity 225B in the core body 220 (FIG. 8). It is also understood that for each casting assembly example below, the values of the minimum core thickness $CT_{min}$, maximum core thickness $CT_{max}$, and hollow area $A_h$ are for a single common cross-sectional plane, such as the first plane 101 (FIG. 3), the cross-sectional plane 201 (FIG. 6), or the cross-sectional plane 301 (FIG. 8).

TABLE 1

| Example: | 1 | 2 | 3 | 4 | 5 | 6 | 7 | 8 | 9 | 10 | 11 | 12 | 13 |
|---|---|---|---|---|---|---|---|---|---|---|---|---|---|
| $A_b$ (in$^2$) | 0.160 | 0.640 | 0.089 | 0.146 | 0.080 | 0.128 | 0.952 | 1.748 | 1.992 | 1.756 | 0.133 | 0.367 | 0.348 |
| $A_h$ (in$^2$) | 0.122 | 0.578 | 0.047 | 0.124 | 0.058 | 0.078 | 0.881 | 1.535 | 1.853 | 1.705 | 0.003 | 0.016 | 0.011 |
| $CT_{min}$ (in) | 0.030 | 0.050 | 0.057 | 0.020 | 0.020 | 0.144 | 0.021 | 0.024 | 0.025 | 0.021 | 0.048 | 0.052 | 0.049 |
| $CT_{max}$ (in) | 0.080 | 0.035 | 0.057 | 0.060 | 0.080 | 0.144 | 0.145 | 0.057 | 0.136 | 0.178 | 0.064 | 0.138 | 0.137 |
| $ST_{min}$ (in) | 0.080 | 0.020 | 0.022 | 0.060 | 0.080 | 0.025 | 0.137 | 0.198 | 0.184 | 0.355 | 0.160 | 0.074 | 0.228 |

During the course of casting assembly design and the time-consuming processes previously described, it was discovered unexpectedly that a relationship exists between the body area $A_b$, the hollow area $A_h$, the minimum core thickness $CT_{min}$, the maximum core thickness $CT_{max}$, and the minimum shell thickness $ST_{min}$ that yielded an improved casting assembly and corresponding cast part. The inventors found that an improved casting assembly could not simply, consistently or reliably be found when based on the performing of disparate experiments, each utilizing various casting-assembly dimensions. Rather, a better and more durable casting assembly and cast part was found when the casting assembly includes at least one core body with a hollow cavity, and the casting assembly having specific dimensions in a particular relationship with one another. This result was unexpected.

The desired relationship is represented by a hollow cavity parameter (denoted "HCP"):

(1)

$$HCP = \frac{A_h}{A_b}\left(\frac{CT_{max}}{CT_{min}}\right)^{\frac{1}{3}}\left(\frac{ST_{min}}{CT_{min}}\right)^{\frac{1}{2}};$$

where $A_b$ is the body area, $A_h$ is the hollow cavity area, $CT_{min}$ is the minimum core thickness, $CT_{max}$ is the maximum core thickness, and $ST_{min}$ is the minimum shell thickness in a single cross-sectional plane through the casting assembly 10, 110, 210. More specifically, the hollow cavity parameter HCP relates to a ratio of the hollow cavity area to the body area $A_h/A_b$, a ratio of the maximum core thickness to the minimum core thickness $CT_{max}/CT_{min}$, and a ratio of the minimum shell thickness to the minimum core thickness $ST_{min}/CT_{min}$.

Expression (1) is valid for a single cross-sectional plane through the casting assembly 10, 110, 210 perpendicular to the axial direction A, such as the first plane 101, second plane 102, third plane 103, cross-sectional plane 201, or cross-sectional plane 301 are as described above. In some implementations, Expression (1) is also valid for each cross-sectional plane through the casting assembly 10, 110, 210 to which the axial direction A is orthogonal. Expression (1) is also valid for each hollow cavity in the casting assembly 10, 110, 210, such as the hollow cavity 25 (FIG. 2), the hollow cavities 125A, 125B (FIG. 6), or the hollow cavities 225A, 225B (FIG. 8).

By utilizing this relationship, the inventors also found that the number of casting assembly designs providing suitable or feasible solutions for a given cast part design could be greatly reduced at the outset, thereby facilitating a more rapid down-selection of casting assembly designs to consider for a given cast part. The discovered relationship provides more insight to the requirements for a given casting assembly, and also avoids or prevents late-stage redesign of the casting assembly for a desired cast part.

Values of the area ratio $A_h/A_b$, the thickness ratios $CT_{max}/CT_{min}$ and $ST_{min}/CT_{min}$, and the hollow cavity parameter HCP corresponding to Examples 1-7 above are provided below in Table 2:

TABLE 2

| Example: | 1 | 2 | 3 | 4 | 5 | 6 | 7 | 8 | 9 | 10 | 11 | 12 | 13 |
|---|---|---|---|---|---|---|---|---|---|---|---|---|---|
| $A_h/A_b$ | 0.76 | 0.90 | 0.53 | 0.85 | 0.73 | 0.61 | 0.93 | 0.88 | 0.93 | 0.97 | 0.02 | 0.04 | 0.03 |
| $CT_{max}/CT_{min}$ | 2.67 | 0.70 | 1.00 | 3.00 | 4.00 | 1.00 | 6.91 | 2.35 | 5.55 | 8.63 | 1.33 | 2.64 | 2.79 |
| $ST_{min}/CT_{min}$ | 2.67 | 0.40 | 0.39 | 3.00 | 4.00 | 0.17 | 6.52 | 8.17 | 7.50 | 17.28 | 3.33 | 1.41 | 4.64 |
| HCP | 1.73 | 0.51 | 0.33 | 2.12 | 2.30 | 0.25 | 4.50 | 3.34 | 4.51 | 8.28 | 0.04 | 0.07 | 0.09 |

It was found that the range of values for the hollow cavity parameter HCP in Table 2 correlate to a casting assembly with a core having a hollow cavity adjacent a ligament, thereby reducing variability in thermal properties and stresses during firing and casting, while also providing for casting of parts (e.g. airfoils) having large interior cavities directly adjacent small apertures that are formed by ligaments in the casting assembly.

In addition, minimum and maximum values for the casting-assembly characteristics described in Table 2, where Expression (1) applies and is consistent with the teachings in this disclosure, are provided below in Table 3:

TABLE 3

| Characteristic | Minimum Value | Maximum Value |
|---|---|---|
| $A_h/A_b$ | 0.02 | 0.99 |
| $CT_{max}/CT_{min}$ | 1.00 | 9.80 |
| $ST_{min}/CT_{min}$ | 0.17 | 18.17 |
| HCP | 0.04 | 8.28 |

As shown above, it was found that a design range for the hollow cavity parameter HCP between 0.04-8.28 provided for a desirable casting assembly, ligament stability, material effects during printing, thermal effects during firing and casting, and material qualities of the finished cast part. The inventors additionally discovered that a narrowed design range for the hollow cavity parameter HCP provided for especially desirable performance of the casting assembly in forming the cast part. In one exemplary implementation, the hollow cavity parameter HCP was between 0.07-4.51. In another exemplary implementation, the hollow cavity parameter HCP was between 0.09-3.34. Such narrowed design ranges provide for more efficient selection of casting assembly characteristics, as well as time and resource savings associated therewith.

Additional benefits associated with the hollow cavity parameter HCP described herein include a quick assessment of design parameters in terms of relative cavity sizes, wall thicknesses, and thermal properties. Bounding these multiple factors to a particular region of possibilities saves time, money, and resources. Additional bounding of the hollow cavity parameter HCP to a narrowed design range provides for even faster assessments of design parameters and more efficient exploration of casting assembly characteristics within a well-suited design space. In addition, the HCP described herein enables the development and production of high-performance and durable cast parts across multiple performance metrics within a given set of constraints.

To the extent one or more structures provided herein can be known in the art, it should be appreciated that the present disclosure can include combinations of structures not previously known to combine, at least for reasons based in part on conflicting benefits versus losses, desired modes of operation, or other forms of teaching away in the art.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and can include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects of the disclosure are provided by the subject matter of the following clauses:

A casting assembly for forming a cast part and defining an axial direction, comprising: a core body extending along the axial direction between a first end and a second end, the core body having a core interior surface and a core exterior surface, with the core interior surface at least partially bounding a hollow cavity, and with the core exterior surface fluidly isolated from the hollow cavity and shaping a part surface of the cast part; and a shell body extending along the axial direction and having a first shell surface and a second shell surface, with at least a portion of the second shell surface facing the exterior surface of the core body; wherein the core body comprises: a body area $A_b$ defined as an area bounded by the core exterior surface in a cross-sectional plane, with the axial direction normal to the cross-sectional plane; a hollow area $A_h$ defined as an area of the hollow cavity bounded by the core interior surface in the cross-sectional plane; a minimum core thickness $CT_{min}$ defined between the core exterior surface and the core interior surface in the cross-sectional plane; and a maximum core thickness $CT_{max}$ defined between the core exterior surface and the core interior surface in the cross-sectional plane; wherein the shell body comprises a minimum shell thickness $ST_{min}$ defined between the first shell surface and the second shell surface in the cross-sectional plane; wherein the body area $A_b$, the hollow area $A_h$, the minimum core thickness $CT_{min}$, the maximum core thickness $CT_{max}$, and the minimum shell thickness $ST_{min}$ define a hollow cavity parameter HCP as:

$$HCP = \frac{A_h}{A_b}\left(\frac{CT_{max}}{CT_{min}}\right)^{\frac{1}{3}}\left(\frac{ST_{min}}{CT_{min}}\right)^{\frac{1}{2}};$$

wherein the hollow cavity parameter HCP is between 0.04-8.28 ($0.04 \leq HCP \leq 8.28$).

The casting assembly of any preceding clause, wherein the hollow cavity parameter HCP is between 0.04-8.28 ($0.04 \leq HCP \leq 8.28$) in all cross-sectional planes perpendicular to the axial direction between the first end and the second end.

The casting assembly of any preceding clause, wherein the hollow cavity parameter HCP is between 0.07-4.51 ($0.07 \leq HCP \leq 4.51$).

The casting assembly of any preceding clause, wherein the hollow cavity parameter HCP is between 0.07-4.51 ($0.07 \leq HCP \leq 4.51$) in all cross-sectional planes perpendicular to the axial direction between the first end and the second end.

The casting assembly of any preceding clause, wherein the hollow cavity parameter HCP is between 0.09-3.34 ($0.09 \leq HCP \leq 3.34$).

The casting assembly of any preceding clause, wherein the hollow cavity parameter HCP is between 0.09-3.34 ($0.09 \leq HCP \leq 3.34$) in all cross-sectional planes perpendicular to the axial direction between the first end and the second end.

The casting assembly of any preceding clause, wherein a ratio of the hollow area $A_h$ to the body area $A_b$ is between 0.02-0.99 ($0.02 \leq A_h/A_b \leq 0.99$).

The casting assembly of any preceding clause, wherein a ratio of the maximum core thickness $CT_{max}$ to the minimum core thickness $CT_{min}$ is between 1.00-9.80 ($1.00 \leq CT_{max}/CT_{min} \leq 9.80$).

The casting assembly of any preceding clause, wherein a ratio of the minimum shell thickness $ST_{min}$ to the minimum core thickness $CT_{min}$ is between 0.36-18.17 ($0.36 \leq ST_{min}/CT_{min} \leq 18.17$).

The casting assembly of any preceding clause, wherein at least one of the body area $A_b$, the hollow area $A_h$, the minimum core thickness $CT_{min}$, the maximum core thickness $CT_{max}$, or the minimum shell thickness $ST_{min}$ are non-constant along the axial direction.

The casting assembly of any preceding clause, further comprising a second shell surface bounding a second hollow cavity in the core body.

The casting assembly of any preceding clause, wherein the hollow cavity defines a hollow cavity width that is variable along the axial direction.

The casting assembly of any preceding clause, wherein the hollow cavity defines a hollow cavity width that is constant along the axial direction.

The casting assembly of any preceding clause, wherein the hollow cavity width has a maximum value at a location spaced from the first end and the second end.

The casting assembly of any preceding clause, wherein the core exterior surface and the second shell surface at least partially define a part cavity, with the part cavity fluidly separated from the hollow cavity.

The casting assembly of any preceding clause, wherein the part cavity defines a part cavity width that is variable along the axial direction.

The casting assembly of any preceding clause, wherein the part cavity defines a part cavity width that is constant along the axial direction.

The casting assembly of any preceding clause, further comprising a ligament extending between the core body and the shell body.

The casting assembly of any preceding clause, wherein the ligament forms a hollow aperture extending through the cast part.

The casting assembly of any preceding clause, wherein the ligament forms a support structure between the core body and the shell body.

The casting assembly of any preceding clause, wherein the core body comprises a central body coupled to an outer layer, with the central body defining the core interior surface and the outer layer defining the core exterior surface.

The casting assembly of any preceding clause, wherein the core body further comprises an inner layer coupled to the central body and defining the core interior surface.

The casting assembly of any preceding clause, wherein at least one of the core body or the shell body comprises monolithic ceramic.

What is claimed is:

1. A casting assembly for forming a cast part and defining an axial direction, comprising:

a core body extending along the axial direction between a first end and a second end, the core body having a core interior surface and a core exterior surface, with the core interior surface at least partially bounding a hollow cavity, and with the core exterior surface fluidly isolated from the hollow cavity and shaping a part surface of the cast part; and a shell body extending along the axial direction and having a first shell surface and a second shell surface, with at least a portion of the second shell surface facing the core exterior surface of the core body;

wherein the core body comprises:

a body area $A_b$ defined as an area bounded by the core exterior surface in a cross-sectional plane through the casting assembly, with the axial direction normal to the cross-sectional plane;

a hollow area $A_h$ defined as an area of the hollow cavity bounded by the core interior surface in the cross-sectional plane;

a minimum core thickness $CT_{min}$ defined between the core exterior surface and the core interior surface in the cross-sectional plane; and a maximum core thickness $CT_{max}$ defined between the core exterior surface and the core interior surface in the cross-sectional plane;

wherein the shell body comprises a minimum shell thickness $ST_{min}$ defined between the first shell surface and the second shell surface in the cross-sectional plane;

wherein the body area $A_b$, the hollow area $A_h$, the minimum core thickness $CT_{min}$, the maximum core thickness $CT_{max}$, and the minimum shell thickness $ST_{min}$ define a hollow cavity parameter HCP as:

$$HCP = \frac{A_h}{A_b}\left(\frac{CT_{max}}{CT_{min}}\right)^{\frac{1}{3}}\left(\frac{ST_{min}}{CT_{min}}\right)^{\frac{1}{2}};$$

wherein the hollow cavity parameter HCP is between 0.04-8.28 ($0.04 \leq HCP \leq 8.28$).

2. The casting assembly of claim 1, wherein the hollow cavity parameter HCP is between 0.04-8.28 ($0.04 \leq HCP \leq 8.28$) in all cross-sectional planes perpendicular to the axial direction between the first end and the second end.

3. The casting assembly of claim 1, wherein the hollow cavity parameter HCP is between 0.07-4.51 ($0.07 \leq HCP \leq 4.51$).

4. The casting assembly of claim 3, wherein the hollow cavity parameter HCP is between 0.07-4.51 ($0.07 \leq HCP \leq 4.51$) in all cross-sectional planes perpendicular to the axial direction between the first end and the second end.

5. The casting assembly of claim 1, wherein the hollow cavity parameter HCP is between 0.09-3.34 ($0.09 \leq HCP \leq 3.34$).

6. The casting assembly of claim 5, wherein the hollow cavity parameter HCP is between 0.09-3.34 ($0.09 \leq HCP \leq 3.34$) in all cross-sectional planes perpendicular to the axial direction between the first end and the second end.

7. The casting assembly of claim 1, wherein a ratio of the hollow area $A_h$ to the body area $A_b$ is between 0.02-0.99 ($0.02 \leq A_h/A_b \leq 0.99$).

8. The casting assembly of claim 1, wherein a ratio of the maximum core thickness $CT_{max}$ to the minimum core thickness $CT_{min}$ is between 1.00-9.80 ($1.00 \leq CT_{max}/CT_{min} \leq 9.80$).

9. The casting assembly of claim 1, wherein a ratio of the minimum shell thickness $ST_{min}$ to the minimum core thickness $CT_{min}$ is between 0.36-18.17 ($0.36 \leq ST_{min}/CT_{min} \leq 18.17$).

10. The casting assembly of claim 1, wherein at least one of the body area $A_b$, the hollow area $A_h$, the minimum core thickness $CT_{min}$, the maximum core thickness $CT_{max}$, or the minimum shell thickness $ST_{min}$ are non-constant along the axial direction.

11. The casting assembly of claim 1, further comprising a second core interior surface bounding a second hollow cavity in the core body.

12. The casting assembly of claim 1, wherein the hollow cavity defines a hollow cavity width that is variable along the axial direction.

13. The casting assembly of claim 12, wherein the hollow cavity width has a maximum value at a location spaced from the first end and the second end.

14. The casting assembly of claim 1, wherein the part cavity defines a part cavity width that is variable along the axial direction.

15. The casting assembly of claim 1, further comprising a ligament extending between the core body and the shell body.

16. The casting assembly of claim 15, wherein the ligament forms a hollow aperture extending through the cast part.

17. The casting assembly of claim 15, wherein the ligament forms a support structure between the core body and the shell body.

18. The casting assembly of claim 1, wherein the core body comprises a central body coupled to an outer layer, with the central body defining the core interior surface and the outer layer defining the core exterior surface.

19. The casting assembly of claim 18, wherein the core body further comprises an inner layer coupled to the central body and defining the core interior surface.

20. A casting assembly for forming a cast part and defining an axial direction, comprising:

a core body extending along the axial direction between a first end and a second end, the core body including a core interior surface and a core exterior surface, wherein the core interior surface at least partially bounds a hollow cavity, wherein the core exterior surface is fluidly isolated from the hollow cavity and shapes a part surface of the cast part; and a shell body extending along the axial direction and including a first shell surface and a second shell surface, wherein at least a portion of the second shell surface faces the core exterior surface of the core body;

wherein the core body comprises:

a body area $A_b$ defined as an area bounded by the core exterior surface in a cross-sectional plane through the casting assembly, wherein the axial direction is normal to the cross-sectional plane;

a hollow area $A_h$ defined as an area of the hollow cavity bounded by the core interior surface in the cross-sectional plane;

wherein a ratio of the hollow area $A_h$ to the body area $A_b$ is between 0.02-0.97($0.02 \leq A_h/A_b \leq 0.97$);

a minimum core thickness $CT_{min}$ defined between the core exterior surface and the core interior surface in the cross-sectional plane; and a maximum core thickness $CT_{max}$ defined between the core exterior surface and the core interior surface in the cross-sectional plane;

wherein a ratio of the maximum core thickness $CT_{max}$ to the minimum core thickness $CT_{min}$ is between 1.00-8.63($1.00 \leq CT_{max}/CT_{min} \leq 8.63$);

wherein the shell body comprises a minimum shell thickness $ST_{min}$ defined between the first shell surface and the second shell surface in the cross-sectional plane;

wherein a ratio of the minimum shell thickness $ST_{min}$ to the minimum core thickness $CT_{min}$ is between 0.17-17.28($0.17 \leq ST_{min}/CT_{min} \leq 17.28$);

wherein the body area $A_b$, the hollow area $A_h$, the minimum core thickness $CT_{min}$, the maximum core thickness $CT_{max}$, and the minimum shell thickness $ST_{min}$ define a hollow cavity parameter HCP as:

$$HCP = \frac{A_h}{A_b}\left(\frac{CT_{\max}}{CT_{\min}}\right)^{\frac{1}{3}}\left(\frac{ST_{\min}}{CT_{\min}}\right)^{\frac{1}{2}};$$

wherein the hollow cavity parameter HCP is between 0.04-8.28($0.04 \leq HCP \leq 8.28$).

* * * * *